US005932036A

United States Patent [19]

Fukai

[11] Patent Number: 5,932,036

[45] Date of Patent: Aug. 3, 1999

[54] METHOD FOR MANUFACTURING TITANIUM ALLOY SHEET

[75] Inventor: Hideaki Fukai, Fukuyama, Japan

[73] Assignee: NKK Corporation, Tokyo, Japan

[21] Appl. No.: 09/107,558

[22] Filed: Jun. 29, 1998

[30] Foreign Application Priority Data

Aug. 14, 1997 [JP] Japan ..... 9-219529

[51] Int. Cl.[6] ..... C22F 1/18

[52] U.S. Cl. ..... 148/670; 29/423; 29/17.6

[58] Field of Search ..... 148/670, 671; 29/423, 17.6

[56] References Cited

U.S. PATENT DOCUMENTS

| | | | |
|---|---|---|---|
| 3,122,423 | 2/1964 | Hessler . | |
| 5,121,535 | 6/1992 | Wittenauer et al. | 29/423 |
| 5,127,146 | 7/1992 | Wittenauer | 29/423 |
| 5,301,403 | 4/1994 | Blank-Bewersdorff et al. | 29/17.5 |
| 5,658,623 | 8/1997 | Batawi et al. . | |

FOREIGN PATENT DOCUMENTS 63-76706 4/1988 Japan .

*Primary Examiner*—John Sheehan

*Attorney, Agent, or Firm*—Frishauf, Holtz, Goodman, Langer & Chick, P.C

[57] ABSTRACT

A method for manufacturing a titanium alloy sheet, which comprises the steps of: covering at least one titanium alloy slab with carbon steel plates, welding together the carbon steel plates by means of a high-energy-density welding under a vacuum atmosphere to prepare a carbon steel envelope, thereby preparing an assembled slab, containing the titanium alloy slab therein, with an interior thereof kept at a degree of vacuum of up to $10^{-2}$; applying, prior to preparation of the assembled slab, a release agent comprising a solid content having a particle size of up to 325 mesh, onto the surfaces of the titanium alloy slab or onto the inner surfaces of the carbon steel envelope facing thereto, adjusting the total applying quantity of the release agent so as to satisfy the following formula: $5{,}000 \leqq X \cdot Y/(1-\sqrt{Z}) \leqq 25{,}000$, where X: weight percentage (wt. %) of the solid content in the release agent, Y: total applying quantity ($ml/m^2$) of the release agent; and Z: degree of vacuum (Torr) in the interior of the assembled slab; and hot-rolling the assembled slab.

8 Claims, 2 Drawing Sheets

METHOD FOR MANUFACTURING TITANIUM ALLOY SHEET

REFERENCE TO PATENTS, APPLICATIONS AND PUBLICATIONS PERTINENT TO THE INVENTION

As far as we know, there are available the following prior art documents pertinent to the present invention:

(1) Japanese Patent Provisional Publication No. JP-A-63-76,706 published on Apr.7, 1988, and (2) U.S. Pat. No. 5,121,535 published on Jun. 16, 1992.

The contents of the prior art disclosed in the above-mentioned prior art documents will be discussed later under the heading of "BACKGROUND OF THE INVENTION".

BACKGROUND OF THE INVENTION

1. Field of the Invention

The present invention relates to a method for manufacturing a titanium alloy sheet, and particularly, to a method for efficiently manufacturing a titanium alloy sheet excellent in surface conditions and workability.

2. Related Art Statement

A titanium alloy sheet, particularly an $\alpha+\beta$ type titanium alloy sheet is conventionally manufactured by a pack-rolling using a plate mill as disclosed in Japanese Patent Provisional Publication No. JP-A-63-76,706 (hereinafter referred to as the "prior art 1").

The pack-rolled titanium alloy sheet is conventionally manufactured by covering at least upper and lower surfaces of a titanium alloy slab with mill scale or a titanium alloy slab subjected to a surface treatment such as descaling with carbon steel plates, and hot-rolling the titanium alloy slab thus covered with the carbon steel plates.

Another conventional pack-rolling comprises the steps, as shown in FIGS. 1 and 2, of covering upper and lower surfaces and peripheral side surfaces of a titanium alloy slab 4 with mill scale or a titanium alloy slab 4 subjected to a surface treatment such as descaling with an envelope comprising carbon steel plates 1 (hereinafter referred to as the "carbon steel envelope") to prepare an assembled slab, providing deaerating holes 5 for discharging air in the interior of the assembled slab during the hot-rolling in the open air, or slits having a function equivalent to the above holes 5, on the carbon steel envelope, and then hot-rolling the titanium alloy slab thus covered with the carbon steel envelope, i.e., the assembled slab. In order to prevent bonding between the carbon steel envelope and the titanium alloy slab housed therein, a release agent is disposed therebetween when preparing the foregoing assembled slab. The above-mentioned assembled slab is prepared by welding together the carbon steel plates 1 on the upper surface, the lower surface and the peripheral side surfaces in the open air along welding grooves 6 provided between the upper and the peripheral side carbon steel plates and between the lower and the peripheral side carbon steel plates.

In general, the temperature of a titanium alloy slab remarkably decreases during the hot-rolling according as the thickness thereof decreases, resulting in a lower workability. According to the method of the prior art 1, since the titanium alloy slab is covered with the carbon steel envelope, there is only a slight decrease in the temperature of the titanium alloy slab during the hot-rolling, thus making it possible to roll the titanium alloy slab within a high temperature range. It is consequently possible to manufacture a titanium alloy sheet by the use of an ordinary hot-rolling mill such as a plate mill.

Further, a commercially pure titanium sheet and a titanium alloy sheet have anisotropy in strength. According to the method for manufacturing a titanium alloy sheet of the prior art 1 based on the pack-rolling using a plate mill, a cross-rolling can be applied, thus permitting reduction of anisotropy in strength of the commercially pure titanium sheet and the titanium alloy sheet.

The U.S. Pat. No. 5,121,535 issued on Jun. 16, 1992 (corresponding to Japanese Patent Provisional Publication No. JP-A-2-263, 504) discloses a method for shaping metal sections of reactive metals comprising the steps of (hereinafter referred to as the "prior art 2"):

(1) encapsulating a reactive first metal in a non-reactive second metal, thereby forming a laminate metal assembly, the principal surfaces of said first metal being separated from said second metal by a layer of a release agent which is substantially chemically inert with respect to said first metal;

(2) forming said metal assembly to a predetermined geometry with means for forming means; and (3) stripping said non-reactive second metal from said reactive first metal.

In the foregoing method of the prior art 2, said encapsulating step comprises the following sub-steps of: (a) preparing a metal frame of said second metal, said metal frame having a window therein, (b) mounting said first metal in said window in said metal frame, (c) interleaving said metal frame and said first metal between two layers of said second metal, thereby forming a laminate metal assembly, and (d) welding said two layers of said second metal to said metal frame, and wherein said two layers of said second metal include surface depressions, and said release agent is disposed in said surface depressions.

In the method of the prior art 2, furthermore, the sub-step of welding the two layers of the second metal to the metal frame comprises an electron beam welding under a vacuum atmosphere.

When applying the method of the prior art 2 to the manufacture of a titanium alloy sheet, the metal assembly under a vacuum atmosphere, which houses the titanium alloy slab therein is hot-rolled. It is therefore possible to restrain the formation of a thick and tight oxide scale on the surface of the titanium alloy slab during the heating and during the hot-rolling of the metal assembly in the open air. It is accordingly possible to omit or simplify an excessive polishing or grinding step by means of a grinder, which serves also for a thickness adjustment, or a shot-blasting step or a pickling step, for removing the thick and tight oxide scale.

Furthermore, according to the method of the prior art 2, which adopts the electron beam welding under a vacuum atmosphere, the interior of the metal assembly tack-welded in the open air can be made a into vacuum atmosphere in a vacuum chamber within a relatively short period of time. More specifically, it is possible to achieve a vacuum atmosphere within a relatively short period of time in the interior of the metal assembly, which interior has a small space because of the titanium alloy slab housed therein, and accordingly has a large deaeration resistance.

The prior arts 1 and 2 have however the following problems. In the prior art 1, in which the hot-rolling is carried out in the open air, an oxide scale and/or a deteriorated layer, in which a large quantity of oxygen is dissolved in the form of solid-solution, are formed during the heating or during the hot-rolling of the assembled slab not only when a slab in the assembled slab is a titanium alloy slab with mill scale, but also even when the slab is a titanium alloy slab subjected to a surface treatment such as descaling. The above-mentioned oxide scale and deteriorated layer cause deterioration of surface conditions of the titanium alloy sheet as a product and a serious decrease in material properties such as bendability. It is therefore necessary to remove these oxide scale and deteriorated layer.

Available methods for removing the oxide scale and the deteriorated layer include a method of polishing and grinding the surface of the titanium alloy sheet by means of a grinder or the like to remove the oxide scale and the deteriorated layer, and a method of using a shot-blasting and a pickling to remove the oxide scale a the deteriorated layer. According to the method of removing the oxide scale and the deteriorated layer by means of a grinder or the like, thickness of the sheet can be simultaneously adjusted. It is therefore possible to manufacture a titanium alloy sheet having a high thickness accuracy and containing only a small strain. A problem is however that, because the titanium alloy sheet having a low machinability and a large area is to be polished or ground, the foregoing descaling step requires a long period of time and the manufacturing cost is higher.

According to the method of removing the oxide scale and the deteriorated layer through the shot-blasting and the pickling, on the other hand, it is possible to complete the descaling in a short period of time. A problem is however that strain occurs by the shot-blasting in the titanium alloy sheet. According to the method of removing the oxide scale and the deteriorated layer only through the pickling, omitting the shot-blasting, on the titanium alloy sheet manufactured by the hot-rolling in the open air, it is impossible to completely remove the thick and tight oxide scale and the deteriorated layer formed during the heating and the hot-rolling of the titanium alloy slab. A problem is therefore that material properties such as bendability of the titanium alloy sheet are seriously decreased.

When subjecting the metal assembly of which the interior is in a vacuum atmosphere to the hot-rolling as in the prior art 2, various problems as in the prior art 1 caused by the thick and tight oxide scale and the deteriorated layer, in which a large quantity of oxygen is dissolved in the form of, can be solved. However, a new surface is produced on the surface of the titanium alloy slab during the above-mentioned hot-rolling under a vacuum atmosphere, and bonding occurs between the non-reactive second metal in the prior art 2 and the reactive first metal in the prior art 2 (i.e., the titanium alloy slab), which compose the metal assembly, or between titanium alloy sheets when two or more piled titanium alloy slabs are encapsulated in the second metal. In order to prevent the foregoing bonding, a release agent is used. However, the release agent comes off during preparing the metal assembly after applying the release agent, and during hot-rolling, thus causing the aforesaid bonding, or the releasing agent coheres, thus causing dents or the like on the surface of the titanium alloy sheet. This results in a problem that the surface conditions of the titanium alloy sheet are deteriorated so seriously that the manufactured titanium alloy sheet cannot be used as a product. According to the method of the prior art 2, furthermore, a special working step is required for providing depressions in the non-reactive second metal. Because the release agent is disposed in the depressions of the second metal, the metal assembly can receive only a sheet of the reactive first metal. This makes it impossible to adopt an efficient method of, for example, forming a plurality of sheets of the reactive first metal by means of a single run of hot-rolling.

Under such circumstances, there is a strong demand for development of a method for efficiently manufacturing a titanium alloy sheet excellent in surface conditions and workability, but such a method has not as yet been proposed.

SUMMARY OF THE INVENTION

An object of the present invention is therefore to provide a method for efficiently manufacturing a titanium alloy sheet excellent in surface conditions and workability by overcoming the problems in the foregoing prior arts.

In accordance with one of the features of the present invention, there is provided a method for manufacturing a titanium alloy sheet, which comprises the steps of:

covering an upper surface, a lower surface and peripheral side surfaces of at least one titanium alloy slab with respective carbon steel plates, and welding together said carbon steel plates by means of a high-energy-density welding under a vacuum atmosphere of up to $10^{-2}$ Torr to prepare a carbon steel envelope, thereby preparing an assembled slab containing said titanium alloy slab therein, with an interior thereof kept at a degree of vacuum of up to $10^{-2}$ Torr;

applying, prior to said preparing step of said assembled slab, a release agent comprising a powdery metal oxide or a powdery metal nitride as a solid content, having a particle size of up to 325 mesh, onto the upper surface and the lower surface of said titanium alloy slab and/or onto respective inner surfaces of said carbon steel envelope facing thereto;

adjusting the total applying quantity of said release agent onto the upper surface and the lower surface of said titanium alloy slab and/or onto the respective inner surfaces of said carbon steel envelope facing thereto so as to satisfy the following formula:

$$5{,}000 \leq X \cdot Y/(1-\sqrt{Z}) \leq 25{,}000$$

where,

X: weight percentage (wt. %) of said solid content in said release agent,

Y: total applying quantity ($ml/m^2$) of said release agent, and

Z: degree of vacuum (Torr) in the interior of said assembled slab prepared by means of said high-energy-density welding;

subjecting the thus prepared assembled slab to a hot-rolling to form said titanium alloy slab in said assembled slab into a titanium alloy sheet having prescribed shape and dimensions; and removing said carbon steel envelope from the thus formed titanium alloy sheet as a product.

In the method of the present invention, prior to said removing step of said carbon steel envelope from said formed titanium alloy sheet, said hot-rolled assembled slab is subjected to a heat treatment.

Further, in the method of the present invention, said heat treatment comprises a creep flattening.

DETAILED DESCRIPTION OF PREFERRED EMBODIMENTS

Figure 1:
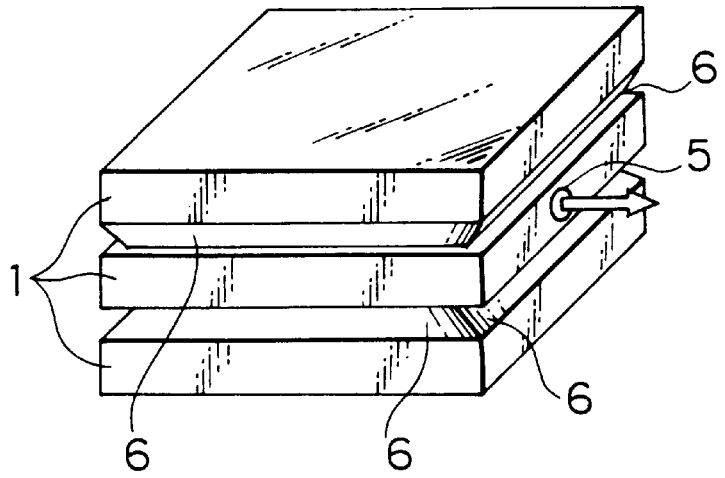
FIG. 1 PRIOR ART
FIG. 1 is a schematic perspective view illustrating the preparing step of an assembled slab in the conventional method.
Figure 2:
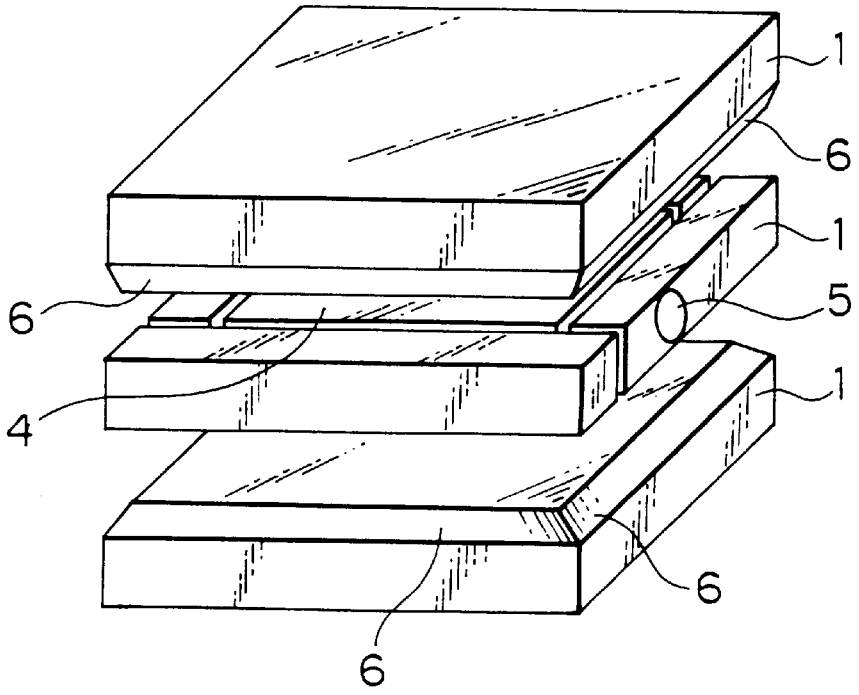
FIG. 2 PRIOR ART
FIG. 2 is a schematic exploded perspective view of the assembled slab in the conventional method, as shown in FIG. 1.

From the above-mentioned point of view, extensive studies were carried out to develop a method for efficiently manufacturing a titanium alloy sheet excellent in surface conditions and workability through a pack-rolling.

As a result, the following findings were obtained: When hot-rolling an assembled slab in which at least one titanium alloy slab is housed in a carbon steel envelope and the interior of which is kept at a vacuum atmosphere, it is possible to easily separate the carbon steel envelope from a titanium alloy sheet as a product, or the titanium alloy sheets as the products from each other after the completion of hot-rolling of the assembled slab, by adjusting the total applying quantity of a release agent onto an upper surface and a lower surface of the titanium alloy slab and/or onto respective inner surfaces of the carbon steel envelope facing thereto so as to satisfy the following formula:

$$5{,}000 \leqq X \cdot Y/(1-\sqrt{Z}) \leqq 25{,}000$$

where,

X: weight percentage (wt. %) of the solid content in the release agent,

Y: total applying quantity ($ml/m^2$) of the release agent, and

Z: degree of vacuum (Torr) in the interior of the assembled slab prepared by means of the high-energy-density welding.

In order to prevent bonding between the carbon steel envelope covering the titanium alloy slab and the titanium alloy slab, or between two or more titanium alloy slabs, it is necessary to adjust a lower limit value of the total applying quantity of the release agent in response to the degree of vacuum in the assembled slab.

More specifically, because an oxide layer formed on the surface of the titanium alloy slab also prevents bonding between the carbon steel envelope covering the titanium alloy slab and the titanium alloy slab, or between two or more titanium alloy slabs, thus, the oxide layer has the same function as that of the release agent, the state of vacuum in the assembled slab affects the total applying quantity of the release agent. With a poor state of vacuum in the assembled slab, the surface of the titanium alloy slab and a new surface formed by the hot-rolling are slightly oxidized by gaseous elements such as oxygen remaining in the assembled slab. The thus formed oxide layer serves to restrain bonding between the carbon steel envelope and the titanium alloy slab, so that a smaller total applying quantity of the release agent suffices when the state of vacuum is not satisfactory.

However, when the state of vacuum is excessively poor in the assembled slab, an oxide scale and/or a deteriorated layer, in which a large quantity of oxygen is dissolved in the form of solid-solution, are formed on the surface of the titanium alloy slab. Surface conditions of the titanium alloy sheet as the product are deteriorated, and an excessive sheet grinding is required. As a result, the surface conditioning including descaling requires far more time and labor, leading to an economic disadvantage. It is therefore necessary to adjust the degree of vacuum in the assembled slab to a value within a prescribed range, and adjust the lower limit value of the total applying quantity of the release agent in response to the degree of vacuum in the assembled slab.

In order to prevent the dents on the surface of the titanium alloy sheet caused by cohesion of the release agent, on the other hand, it is necessary to adjust the upper limit value of the total applying quantity of the release agent in response to the degree of vacuum in the assembled slab. More specifically, when applying the release agent in a large quantity over the prescribed quantity in order to prevent bonding between the carbon steel envelope covering the titanium alloy slab and the titanium alloy slab, or between two or more titanium alloy slabs, the release agent coheres and the dents occur on the surface of the titanium alloy sheet as a product. When applying the release agent in a small quantity under the prescribed quantity, bonding occurs between the carbon steel envelope and the titanium alloy slab, or between the titanium alloy slabs, although the occurrence of the dents caused by coherence of the release agent can be restrained.

In addition, the following findings were obtained: When subjecting the titanium alloy sheet taken out from the carbon steel envelope after the completion of hot-rolling of the assembled slab to a heat treatment or a creep flattening in the open air, surface oxidation occurs on the titanium alloy sheet during the heat treatment after the hot-rolling even if the interior of the hot-rolled assembled slab is under a vacuum atmosphere. In order to remove an oxide layer on the surface of the titanium alloy sheet caused by the surface oxidation, it is necessary to apply a shot-blasting or a pickling. Application of the shot-blasting however causes strain in the titanium alloy sheet. It is therefore possible to prevent oxidation of the titanium alloy sheet by subjecting the assembled slab to a heat treatment without taking out the titanium alloy sheet from the carbon steel envelope after the completion of the hot-rolling of the assembled slab, thereby improving workability and ductility thereof, and further, to prevent the occurrence of strain in the titanium alloy sheet and improve workability and ductility by subjecting the assembled slab to a creep flattening.

The present invention was developed on the basis of the foregoing findings, and a method of the present invention for manufacturing a titanium alloy sheet comprises the steps of:

covering an upper surface, a lower surface and peripheral side surfaces of at least one titanium alloy slab with respective carbon steel plates, and welding together said carbon steel plates by means of a high-energy-density welding under a vacuum atmosphere of up to $10^{-2}$ Torr to prepare a carbon steel envelope, thereby preparing an assembled slab containing said titanium alloy slab therein, with an interior thereof kept at a degree of vacuum of up to $10^{-2}$ Torr;

applying, prior to said preparing step of said assembled slab, a release agent comprising a powdery metal oxide or a powdery metal nitride as a solid content, having a particle size of up to 325 mesh, onto the upper surface and the lower surface of said titanium alloy slab or onto respective inner surfaces of said carbon steel envelope facing thereto;

adjusting the total applying quantity of said release agent onto the upper surface and the lower surface of said titanium alloy slab and/or onto the respective inner surfaces of said carbon steel envelope facing thereto so as to satisfy the following formula:

$$5{,}000 \leqq X \cdot Y/(1-\sqrt{Z}) \leqq 25{,}000$$

where,

X: weight percentage (wt. %) of said solid content in said release agent,

Y: total applying quantity ($ml/m^2$) of said release agent, and

Z: degree of vacuum (Torr) in the interior of said assembled slab prepared by means of said high-energy-density welding;

subjecting the thus prepared assembled slab to a hot-rolling to form said titanium alloy slab contained in said assembled slab into a titanium alloy sheet having prescribed shape and dimensions; and removing said carbon steel envelope from the thus formed titanium alloy sheet as a product.

Further, in the method of the present invention, prior to said removing step of said carbon steel envelope from said formed titanium alloy sheet, said hot-rolled assembled slab is subjected to a heat treatment.

Now, the method of the present invention will be described below in detail with reference to the drawings.

Figure 3:
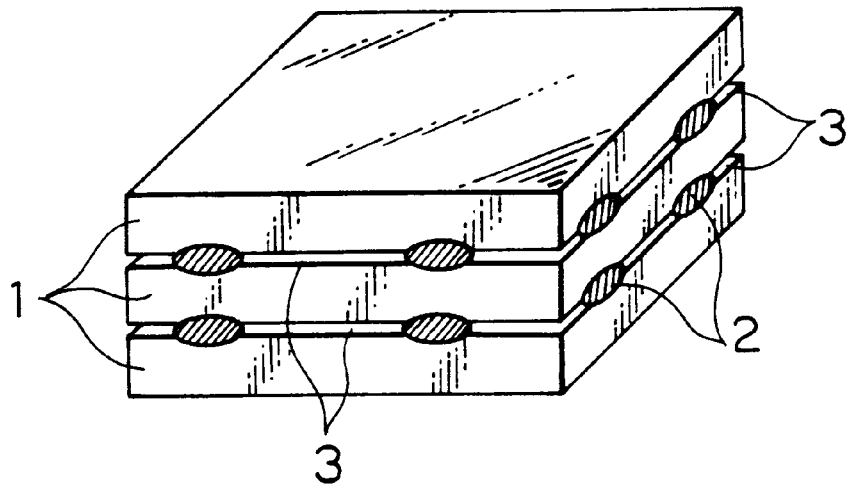
FIG. 3 is a schematic perspective view illustrating an embodiment of the preparing step of an assembled slab using an electron beam welding in the method of the present invention.
Figure 4:
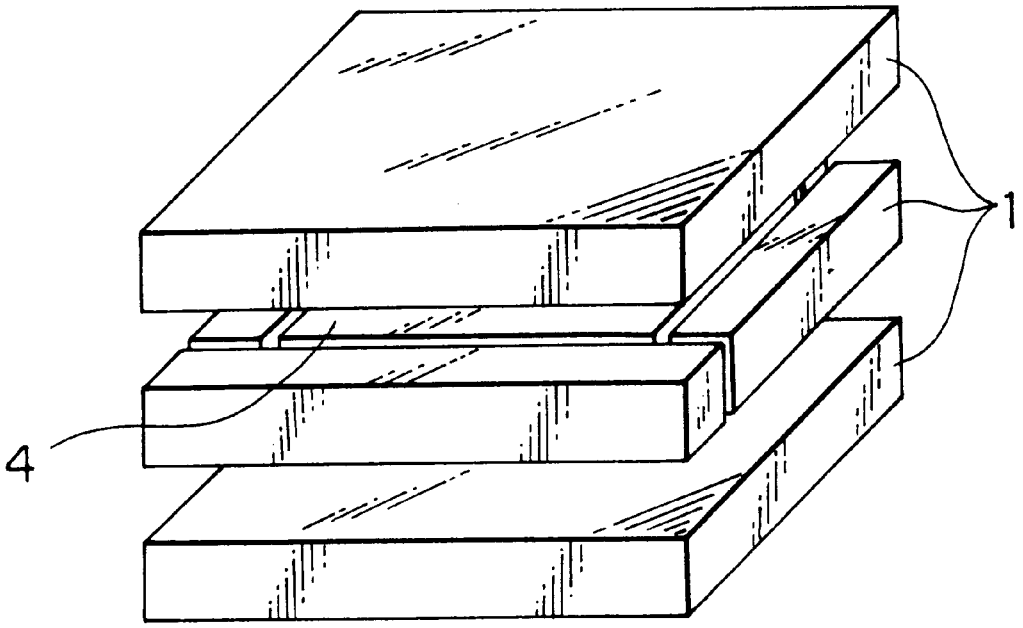
FIG. 4 is a schematic exploded perspective view of the assembled slab in the method of the present invention, as shown in FIG. 3.

FIG. 3 is a schematic perspective view illustrating an embodiment of the preparing step of an assembled slab using an electron beam welding in the method of the present invention; and FIG. 4 is a schematic exploded perspective view of the assembled slab in the method of the present invention, as shown in FIG. 3. In FIG. 3, 1 is a carbon steel plate; 2 is a tack-welded joint; and 3 is a deaerating section. In FIG. 4, 4 is a titanium alloy slab.

As shown in FIGS. 3 and 4, an upper surface, a lower surface and peripheral side surfaces of at least one titanium alloy slab are covered with respective carbon steel plates 1, and the carbon steel plates 1 are tack-welded together in the open air to prepare a tack-welded carbon steel envelope, thereby preparing a provisional assembled slab containing the titanium alloy slab therein. The provisional assembled slab thus prepared is then housed in a vacuum chamber (not shown), to deaerate from the interior of the tack-welded carbon steel envelope through the deaerating section 3 thereof in a vacuum atmosphere of up to $10^{-2}$ Torr. Then, all gaps including the deaerating section 3 of the carbon steel envelope are welded, thereby preparing an assembled slab containing the titanium alloy slab therein, with an interior thereof kept at a degree of vacuum of up to $10^{-2}$ Torr.

In the method of the present invention, the assembled slab of which the interior is kept at a vacuum atmosphere is subjected to a hot-rolling. The reason is that it is possible to restrain, during the hot-rolling, the formation of a thick and tight oxide scale and/or a deteriorated layer, in which a large quantity of oxygen is dissolved in the form of solid-solution, on the surface of the titanium alloy slab.

The assembled slab is prepared in the vacuum chamber by means of the high-energy-density welding such as an electron beam welding. The reason is that, because deaeration from the tack-welded carbon steel envelope can be easily accomplished, it is possible to reduce deaeration resistance, and obtain a prescribed degree of vacuum in a short period of time. In addition, since the assembled slab is prepared by means of the high-energy-density welding, it is possible to omit the step of providing welding grooves on the carbon steel envelope. Furthermore, it is possible to effectively restrain the formation of the oxide scale and/or the deteriorated layer on the surface of the titanium alloy sheet during the heating and the hot-rolling of the assembled slab by adjusting the degree of vacuum in the interior of the assembled slab to up to $10^{-2}$ Torr. As a result, workability of the titanium alloy sheet manufactured by the hot-rolling of the assembled slab is improved. The titanium alloy sheet, from which the carbon steel envelope has been removed after the hot-rolling of the assembled slab, does not require an excessive sheet grinding, thus making it possible to largely simplify the surface conditioning step. As compared with the conventional method, therefore, the method of the present invention provides not only a titanium alloy sheet excellent in material properties but also more favorable economic merits.

In order to prevent bonding between the titanium alloy sheets and between the titanium alloy sheet and the carbon steel envelope, it is necessary to apply a release agent onto the contact surfaces between the titanium alloy slab and the carbon steel envelope and between the titanium alloy slabs, when hot-rolling the assembled slab. In order to restrain the foregoing bonding and cohesion of the release agent on the surface of the titanium alloy sheet, on the other hand, it is necessary to adjust the quantity of solid content in the release agent. The quantity of release agent necessary for preventing the above-mentioned bonding and cohesion is dependent upon the degree of vacuum in the interior of the assembled slab. More specifically, with a relatively low degree of vacuum in the interior of the assembled slab, the surface of the titanium alloy slab is slightly oxidized by oxygen remaining in the assembled slab even if a new surface is formed on the titanium alloy slab under the effect of the hot-rolling of the assembled slab. The thus formed oxide layer restrains bonding between the titanium alloy slab and the carbon steel envelope and/or between the titanium alloy slabs. It is consequently possible to reduce the quantity of the solid content in the release agent. Therefore, the total applying quantity of the release agent onto the surfaces of the titanium alloy slab, or onto the respective inner surfaces of the carbon steel envelope facing to the surfaces of the titanium alloy slab, is adjusted in response to the quantity of the solid content in the release agent and the degree of vacuum in the interior of the assembled slab.

More particularly, it is possible not only to prevent the dents on the surface of the titanium alloy sheet as a product caused by cohesion of the release agent during the hot-rolling of the assembled slab, but also to easily separate the carbon steel envelope from the titanium alloy sheet as the product or the titanium alloy sheets as the products from each other, after the completion of the hot-rolling of the assembled slab, by adjusting the total applying quantity of the release agent comprising a powdery metal oxide or a powdery metal nitride as a solid content, having a particle size of up to 325 mesh (in accordance with JIS K 6900) so as to satisfy the following formula:

$$5{,}000 \leq X \cdot Y/(1-\sqrt{Z}) \leq 25{,}000$$

where,

X: weight percentage (wt. %) of the solid content in the release agent,

Y: total applying quantity ($ml/m^2$) of the release agent, and

Z: degree of vacuum (Torr) in the interior of the assembled slab prepared by means of said high-energy-density welding.

When the particle size of the powdery metal oxide or the powdery metal nitride as the solid content in the release agent is large over 325 mesh, clogging is caused in a sprayer, thus making it impossible to achieve uniform application of the release agent. Dents caused by the powdery metal oxide or the powdery metal nitride itself as the solid content in the release agent easily occur on the surface of the titanium alloy sheet as the product. Further, when the value of $X \cdot Y/(1-\sqrt{Z})$ is over 25,000, the quantity of the solid content in the release agent becomes so large that the dents caused by cohesion of the release agent easily occur on the surface of the titanium alloy sheet as the product. With a value of $X \cdot Y/(1-\sqrt{Z})$ of under 5,000, on the other hand, the total applying quantity of the release agent becomes so small that there is occurred bonding between the titanium alloy sheets and between the titanium alloy sheet and the carbon steel envelope during the hot-rolling of the assembled slab. As a result, after the completion of the hot-rolling of the assembled slab, it is impossible to easily separate the carbon steel envelope from the titanium alloy sheet as the product, or the titanium alloy sheets as the products from each other. This not only causes deterioration of the surface conditions of the manufactured titanium alloy sheet, but also may make it impossible to use the titanium alloy sheet as a product.

The metal oxide or the metal nitride as the solid content in the release agent must comprise a substance having an ability of preventing bonding between the metals even after the hot-rolling when applied onto the contact surface between the metals, and more particularly, comprise alumina, zirconia, boron nitride or titania.

When, after the completion of the hot-rolling of the assembled slab, a heat treatment is applied to the assembled slab without taking out the titanium alloy sheet from the carbon steel envelope, oxide scale is never formed on the surface of the titanium alloy sheet even by applying the heat treatment in the open air, because the interior of the assembled slab remains in the state of vacuum, and it is possible to adjust the microstructure of the titanium alloy sheet through the annealing, thus permitting improvement of the balance between strength and ductility of the titanium alloy sheet.

By subjecting the assembled slab to creep flattening, furthermore, it is possible to prevent strain in the titanium alloy sheet without formation of the thick and tight oxide scale on the surface of the titanium alloy sheet for the same reason as above. It is at the same time possible to adjust the microstructure of the titanium alloy sheet through the annealing, thus permitting improvement of the balance between strength and ductility of the titanium alloy sheet. When subjecting the titanium alloy sheet taken out from the carbon steel envelope after the completion of the hot-rolling of the assembled slab to the foregoing heat treatment or creep flattening, it is necessary to remove the oxide layer formed on the surface of the titanium alloy sheet by means of the shot-blasting or the pickling. The shot-blasting however causes strain in the titanium alloy sheet. When an oxide layer is formed on the surface of the titanium alloy sheet as a result of a heat treatment and a creep flattening in the open air, it is necessary to subject the titanium alloy sheet to a surface conditioning such as excessive sheet grinding, and in addition, this oxide layer causes deterioration of workability of the titanium alloy sheet. There occur therefore deterioration of material properties of the titanium alloy sheet, and an increased manufacturing cost is economically unfavorable.

Now, the method of the present invention will be described further in detail by means of examples while comparing with examples for comparison.

EXAMPLES

EXAMPLE 1

A Ti-4.5 wt. % Al-3 wt. % V-2 wt. % Mo-2 wt. % Fe alloy was employed as a material for a titanium alloy slab. Three titanium alloy slabs each having the foregoing chemical composition and having dimensions of a thickness of 20 mm, a width of 100 mm and a length of 150 mm, were piled up. An upper surface of the uppermost slab, a lower surface of the lowermost slab, and peripheral side surfaces of the three slabs were covered with respective carbon steel plates, and the carbon steel plates were tack-welded together in the open air to prepare a tack-welded carbon steel envelope, thereby preparing a provisional assembled slab containing the three titanium alloy slabs therein, and having dimensions of a thickness of 180 mm, a width of 150 mm and a length of 200 mm.

When preparing the above-mentioned provisional assembled slab, a release agent in a quantity of 300 ml/m$^2$, comprising a powdery alumina as a solid content in a quantity of 50 wt. %, having a particle size of 325 mesh, was applied onto the surfaces of the three titanium alloy slabs.

Then, the thus prepared provisional assembled slab was housed in a vacuum chamber to deaerate from the interior of the tack-welded carbon steel envelope. Then, the carbon steel plates forming the carbon steel envelope were welded together in a vacuum atmosphere by means of an electron beam welding, thereby preparing an assembled slab having dimensions of a thickness of 180 mm, a width of 150 mm and a length of 200 mm, and containing the three titanium alloy slabs therein, each having the above-mentioned dimensions, with an interior kept at a degree of vacuum (Torr) as shown in Table 1.

Then, the thus prepared assembled slab was heated to a temperature of about 850° C. and subjected to a hot-rolling comprising a cross-rolling by means of a plate mill within a temperature range of from 830 to 680° C. to form three titanium alloy sheets. Then, the carbon steel envelope was removed from the thus formed titanium alloy sheets, thereby preparing three titanium alloy sheets, each having dimensions of a thickness of 2 mm, a width of 250 mm and a length of 500 mm, within the scope of the present invention (hereinafter referred to as the "samples of the invention") Nos. A01 to A04.

For comparison purposes, three titanium alloy slabs, each having the same chemical composition and the same dimensions as in the samples of the invention Nos. A01 to A04, were used, and an assembled slab, having dimensions of a thickness of 180 mm, a width of 150 mm and a length of 200 mm, and containing the three titanium alloy slabs therein with an interior kept at a degree of vacuum (Torr) as shown in Table 1, was prepared in the same manner as in the samples of the invention Nos. A01 to A04, except that the degree of vacuum during the electron beam welding was low outside the scope of the present invention.

Then, the thus prepared assembled slab was subjected to the hot-rolling comprising the cross-rolling in the same manner as in the samples of the invention Nos. A01 to A04 to form three titanium alloy sheets. Then, the carbon steel envelope was removed from the thus formed titanium alloy sheets, thereby preparing three titanium alloy sheets, each having dimensions of a thickness of 2 mm, a width of 250 mm and a length of 500 mm, outside the scope of the present invention (hereinafter referred to as the "sample for comparison") No. A05.

For each of the above-mentioned samples of the invention Nos. A01 to A04 and sample for comparison No. A05, the state of formation of an oxide scale and a deteriorated layer was investigated through a sectional microstructural observation. The results are shown in Table 1. Then, after subjecting the samples of the invention Nos. A01 to A04 and the sample for comparison No. A05 to a pickling without applying a shot-blasting, workability was investigated through a bending test. The results are shown also in Table 1

TABLE 1

| Sample No. | Decree of vacuum (Torr) | Thickness of oxide scale | Thickness of deteriorated layer | Critical bend factor (R/t) | Remarks |
|---|---|---|---|---|---|
| A01 | $9 \times 10^{-3}$ | ≦ 1μm | ≦ 1 μm | 4 | Sample of the invention |
| A02 | $1 \times 10^{-4}$ | ≦ 1μm | ≦ 1 μm | 3 | Sample of the invention |
| A03 | $5 \times 10^{-5}$ | ≦ 1μm | ≦ 1 μm | 3 | Sample of the invention |
| A04 | $5 \times 10^{-5}$ | ≦ 1μm | ≦ 1 μm | 3 | Sample of the invention |
| A05 | $5 \times 10^{-2}$ | 17 μm | 7 μm | 6 | Sample for comparison |

As is confirmed from Table 1, the formation of the surface scale and the deteriorated layer caused by gaseous elements remaining in the interior of the assembled slab, was remarkably restrained during the heating and the hot-rolling of the assembled slab in the samples of the invention Nos. A01 to A04 in which the degree of vacuum in the interior of the assembled slab was kept in a satisfactory vacuum state of up to $1\times10^{-2}$ within the scope of the present invention. Accordingly, the critical bend factor (i.e., the ratio of a punch radius of a bending tester to a sample thickness upon the occurrence of a crack in the sample) of the samples of the invention Nos. A01 to A04 was up to 4, representing a satisfactory bendability. In the sample for comparison No. A05, in contrast, the thick oxide scale and the thick deteriorated layer were formed during the heating and the hot-rolling of the assembled slab because the degree of vacuum in the interior thereof was poor outside the scope of the present invention with a value of $5\times10^{-2}$ Torr. Accordingly, the critical bend factor of the sample for comparison No. A05 was 6, representing a bendability inferior to that of the samples of the invention Nos. A01 to A04.

EXAMPLE 2

A Ti-6 wt. % Al-4 wt. % V alloy was employed as a material for a titanium alloy slab. An upper surface, a lower surface and peripheral side surfaces of a slab having the foregoing chemical composition and having dimensions of a thickness of 20 mm, a width of 100 mm and a length of 150 mm, were covered with respective carbon steel plates, and the carbon steel plates were tack-welded together in the open air to prepare a tack-welded carbon steel envelope, thereby preparing a provisional assembled slab containing the titanium alloy slab and having dimensions of a thickness of 140 mm, a width of 150 mm and a length of 200 mm.

When preparing the above-mentioned provisional assembled slab, a release agent in a quantity of 300 ml/m$^2$, comprising a powdery alumina as a solid content in a quantity of 50 wt. %, having a particle size of 325 mesh, was applied onto the upper surface and the lower surface of the titanium alloy slab.

Then, the thus prepared provisional assembled slab was housed in a vacuum chamber to deaerate from the interior of the tack-welded carbon steel envelope. Then, the carbon steel plates forming the carbon steel envelope were welded together in a vacuum atmosphere by means of an electron beam welding, thereby preparing an assembled slab having dimensions of a thickness of 140 mm, a width of 150 mm and a length of 200 mm, and containing the titanium alloy slab therein, having the above-mentioned dimensions, with an interior kept at a degree of vacuum (Torr) as shown in Table 2.

Then, the thus prepared assembled slab was heated to a temperature of about 950° C. and subjected to a hot-rolling comprising a cross-rolling by means of a plate mill within a temperature range of from 930 to 780° C. to form a titanium alloy sheet. Then, the carbon steel envelope was removed from the thus formed titanium alloy sheet, thereby preparing a titanium alloy sheet having dimensions of a thickness of 2 mm, a width of 250 mm and a length of 500 mm, within the scope of the present invention (hereinafter referred to as the "samples of the invention") Nos. B01 to B04.

For comparison purposes, a titanium alloy slab having the same chemical composition and the same dimensions as in the samples of the invention Nos. B01 to B04, was used, and an assembled slab, having dimensions of a thickness of 140 mm, a width of 150 mm and a length of 200 mm, and containing the titanium alloy slab therein with an interior kept at a degree of vacuum (Torr) as shown in Table 2, was prepared in the same manner as in the samples of the invention Nos. B01 to B04, except that the degree of vacuum during the electron beam welding was low outside the scope of the present invention.

Then, the thus prepared assembled slab was subjected to the hot-rolling comprising the cross-rolling in the same manner as in the samples of the invention Nos. B01 to B04 to form a titanium alloy sheet. Then, the carbon steel envelope was removed from the thus formed titanium alloy sheet, thereby preparing a titanium alloy sheet having dimensions of a thickness of 2 mm, a width of 250 mm and a length of 500 mm, outside the scope of the present invention (hereinafter referred to as the "sample for comparison") No. B05.

For each of the above-mentioned samples of the invention Nos. B01 to B04 and sample for comparison No. B05, the state of formation of an oxide scale and a deteriorated layer was investigated through a sectional microstructural observation. The results are shown in Table 2. Then, after subjecting the samples of the invention Nos. B01 to B04 and the sample for comparison No. B05 to a pickling without applying a shot-blasting, workability was investigated through a bending test. The results are shown also in Table 2.

TABLE 2

| Sample No. | Decree of vacuum (Torr) | Thickness of oxide scale | Thickness of deteriorated layer | Critical bend factor (R/t) | Remarks |
|---|---|---|---|---|---|
| B01 | $9 \times 10^{-3}$ | ≦ 1μm | ≦ 1 μm | 6 | Sample of the invention |
| B02 | $1 \times 10^{-4}$ | ≦ 1μm | ≦ 1 μm | 5 | Sample of the invention |
| B03 | $5 \times 10^{-5}$ | ≦ 1μm | ≦ 1 μm | 5 | Sample of the invention |
| B04 | $1 \times 10^{-5}$ | ≦ 1μm | ≦ 1 μm | 5 | Sample of the invention |
| B05 | $5 \times 10^{-2}$ | 17 μm | 9 μm | 8 | Sample for comparison |

As is confirmed from Table 2, the formation of the surface scale and the deteriorated layer caused by gaseous elements remaining in the interior of the assembled slab, was remarkably restrained during the heating and the hot-rolling of the assembled slab in the samples of the invention Nos. B01 to B04 in which the degree of vacuum in the interior of the assembled slab was kept in a satisfactory vacuum state of up to $1\times10^{-2}$ within the scope of the present invention. Accordingly, the critical bend factor in the samples of the invention Nos. B01 to B04 was up to 6, representing a satisfactory bendability. In the sample for comparison No. B05, in contrast, the thick oxide scale and the thick deteriorated layer were formed during the heating and the hot-rolling of the assembled slab because the degree of vacuum in the interior thereof was poor outside the scope of the present invention with a value of $5\times10^{-2}$ Torr. Accordingly, the critical bend factor of the sample for comparison No. B05 was 8, representing a bendability inferior to that of the samples of the invention Nos. B01 to B04.

EXAMPLE 3

A Ti-4.5 wt. % Al-3 wt. % V-2 wt. % Mo-2 wt. % Fe alloy was employed as a material for a titanium alloy slab. Two titanium alloy slabs each having the foregoing chemical composition and having dimensions of a thickness of 20 mm, a width of 100 mm and a length of 150 mm, were piled up. An upper surface of the upper slab, a lower surface of the lower slab, and peripheral side surfaces of the two slabs were covered with respective carbon steel plates, and the carbon steel plates were tack-welded together in the open air to prepare a tack-welded carbon steel envelope, thereby preparing a provisional assembled slab containing the two titanium alloy slabs therein, and having dimensions of a thickness of 160 mm, a width of 150 mm and a length of 200 mm.

When preparing the above-mentioned provisional assembled slab, a release agent in a quantity (ml/m$^2$) as shown in Table 4 comprising a powdery alumina, a powdery zirconia, a powdery boron nitride or a powdery titania as a solid content having a particle size (mesh) and in a quantity (wt.%) as shown in Table 3, was applied onto the surfaces of the two titanium alloy slabs.

In applying the foregoing release agent, a value of $X\cdot Y/(1-\sqrt{Z})$ representing the total applying quantity of the release agent, where, X: weight percentage (wt. %) of the solid content in the release agent, Y: total applying quantity (ml/m$^2$) of the release agent, and Z: degree of vacuum (Torr) in the interior of the assembled slab prepared by means of an electron beam welding, was adjusted to that as shown in Table 4.

Then, the thus prepared provisional assembled slab was housed in a vacuum chamber to deaerate from the interior of the tack-welded carbon steel envelope. Then, the carbon steel plates forming the carbon steel envelope were welded together in a vacuum atmosphere by means of an electron beam welding, thereby preparing an assembled slab having dimensions of a thickness of 160 mm, a width of 150 mm and a length of 200 mm, and containing the two titanium alloy slabs therein, each having the above-mentioned dimensions, with an interior kept at a degree of vacuum (Torr) as shown in Table 3.

Then, the thus prepared assembled slab was heated to a temperature of about 850° C. and subjected to a hot-rolling comprising a cross-rolling by means of a plate mill within a temperature range of from 830 to 680° C. to form two titanium alloy sheets. Then, prior to removing the carbon steel envelopes from the thus formed two titanium alloy sheets, the assembled slab was subjected to a heat treatment at a temperature of 720° C. for an hour, and then, the two titanium alloy sheets, from which the carbon steel envelope were removed, were subjected to a pickling, thereby preparing titanium alloy sheets within the scope of the present invention (hereinafter referred to as the "samples of the invention") Nos. C01, C03, C05 to C09 and C11, and titanium alloy sheets outside the scope of the invention (hereinafter referred to as the "samples for comparison") Nos. C02, C04 and C10, each having dimensions of a thickness of 2 mm, a width of 250 mm and a length of 500 mm.

For each of the above-mentioned samples of the invention and the samples for comparison, the state of occurrence of bonding between the sample and the carbon steel envelope and between the samples and the state of occurrence of dents on the surface of the sample were investigated. The results are shown also in Table 4. In the column of bonding in Table 4, the mark "o" represents a case where no bonding occurred between the sample and the carbon steel envelope and between the samples, and separation of the carbon steel envelope from the sample and separation of the samples from each other were easy; and the mark "x" represents a case where the foregoing bonding occurred and the foregoing separation was difficult. In the column of dents in Table 4, the mark "o" represents a case where no large dent occurred on the sample surface, and the mark "x" represents a case where large dents occurred on the sample surface.

TABLE 3

| Sample No. | Decree of vacuum (Torr) | Kind of solid content | Particle size of solid content (mesh) | Quantity of solid content (wt. %) | Remarks |
|---|---|---|---|---|---|
| C01 | $8\times10^{-3}$ | Alumina | 325 | 50 | Sample of the invention |
| C02 | $2\times10^{-4}$ | Alumina | 270 | 50 | Sample for comparison |
| C03 | $2\times10^{-4}$ | Alumina | 325 | 50 | Sample of the invention |
| C04 | $2\times10^{-4}$ | Alumina | 325 | 40 | Sample for comparison |
| C05 | $2\times10^{-4}$ | Alumina | 325 | 50 | Sample of the invention |
| C06 | $2\times10^{-4}$ | Zirconia | 325 | 50 | Sample of the invention |
| C07 | $2\times10^{-4}$ | Boron nitride | 325 | 50 | Sample of the invention |
| C08 | $2\times10^{-4}$ | Titania | 325 | 50 | Sample of the invention |
| C09 | $2\times10^{-4}$ | Alumina | 325 | 40 | Sample of the invention |
| C010 | $2\times10^{-4}$ | Alumina | 325 | 50 | Sample for comparison |
| C011 | $4\times10^{-5}$ | Alumina | 325 | 50 | Sample of the invention |

TABLE 4

| Sample No. | Applying quantity of release agent ($ml/m^2$) | $X \cdot Y/(1-\sqrt{Z})$ | Bonding | Dent | Remarks |
|---|---|---|---|---|---|
| C01 | 300 | 16473 | ○ | ○ | Sample of the invention |
| C01 | 300 | 16473 | ○ | ○ | Sample of the invention |
| C02 | 300 | 15215 | ○ | X | Sample for comparison |
| C03 | 300 | 15215 | ○ | ○ | Sample of the invention |
| C04 | 100 | 4057 | X | ○ | Sample for comparison |
| C05 | 100 | 5972 | ○ | ○ | Sample of the invention |
| C06 | 300 | 15215 | ○ | ○ | Sample of the invention |
| C07 | 300 | 15215 | ○ | ○ | Sample of the invention |
| C08 | 300 | 15215 | ○ | ○ | Sample of the invention |
| C09 | 300 | 15215 | ○ | ○ | Sample of the invention |
| C010 | 500 | 25359 | ○ | X | Sample for comparison |
| C011 | 300 | 15095 | ○ | ○ | Sample of the invention |

As is confirmed from Tables 3 and 4, in the samples of the invention Nos. C01, C03, C05 to C09 and C11, in which the particle size of the solid content in the release agent was up to 325 mesh within the scope of the present invention, and the total applying quantity of the release agent was adjusted so as to satisfy the following formula:

$$5{,}000 \leqq X \cdot Y/(1-\sqrt{Z}) \leqq 25{,}000$$

where,

X: weight percentage (wt. %) of the solid content in the release agent,

Y: total applying quantity ($ml/m^2$) of the release agent, and

Z: degree of vacuum (Torr) in the interior of the assembled slab prepared by means of the electron beam welding, no bonding occurred between the sample and the carbon steel envelope and between the samples, and therefore, separation of the carbon steel envelope from the sample and separation of the samples from each other could easily be done, and no large dent occurred on the sample surface.

In the sample for comparison No. C02, in contrast, large dents were caused by the solid content itself in the release agent because the particle size of the solid content in the release agent was large outside the scope of the present invention with a value of 270 mesh. In the sample for comparison No. C04, bonding occurred between the sample and the carbon steel envelope and between the samples because the value of $X \cdot Y(1-\sqrt{Z})$ representing the total applying quantity of the release agent was so small as 4,057 outside the scope of the present invention, and as a result, separation of the carbon steel envelope from the sample and separation of the samples from each other were difficult. In the sample for comparison No. C10, the release agent cohered because the value of $X \cdot Y/(1-\sqrt{Z})$ representing the total applying quantity of the release agent was so large as 25,359 outside the scope of the present invention, and as a result, large dents occurred on the sample surface.

In the examples 1 to 3 described above, the Ti-4.5 wt. % Al-3 wt. % V-2 wt. % Mo-2 wt. % Fe alloy or the Ti-6 wt. % Al-4 wt. % V alloy was employed as a material for titanium alloy slabs. The titanium alloys used in the present invention are not however limited to these alloys, but applicable titanium alloys include a Ti-6 wt. % Al-2 wt. % Sn-4 wt. % Zr-6 wt. % Mo alloy, a Ti-8 wt. % Al-1 wt. % Mo-1 wt. % V alloy and a Ti-5 wt. % Al-2.5 wt. % Sn alloy and so on. In the examples 1 to 3, the electron beam welding was applied as the high-energy-density welding in a vacuum atmosphere. However, the high-energy-density welding in the method of the present invention is not limited to this, but a laser beam welding is also applicable. Further, the number of titanium alloy slabs to be contained in the carbon steel envelope may be arbitrary.

According to the method of the present invention, as described above in detail, it is possible to efficiently manufacture a titanium alloy sheet excellent in surface conditions and workability, thus providing industrially useful effects.

What is claimed is:

1. A method for manufacturing a titanium alloy sheet, which comprises:

(a) providing at least one alloy slab having an upper surface, a lower surface and peripheral side surfaces, (b) providing respective carbon steel plates, each having an inner surface, for covering said surfaces of the at least one alloy slab, (c) applying a release agent comprising a solid content of a powdery metal oxide or a powdery metal nitride and having a particle size of up to 325 mesh onto the upper surface and the lower surface of the at least one titanium alloy slab and/or onto the inner surface of the carbon steel plates, (d) covering the upper surface, the lower surface and the peripheral side surfaces of the at least one titanium alloy slab with the respective carbon steel plates, so that the inner surface of each of the carbon steel plates face the at least one titanium alloy slab, and welding together said carbon steel plates by a high-energy-density welding under a vacuum atmosphere of up to $10^{-2}$ Torr to prepare a carbon steel envelope, thereby preparing an assembled slab containing said titanium alloy slab in the carbon steel envelope, with an interior thereof kept at a degree of vacuum of up to $10^{-2}$ Torr;

(e) adjusting the total applying quantity of said release agent onto the upper surface and the lower surface of said at least one titanium alloy slab and/or onto the respective inner surfaces of said carbon steel plates to satisfy the following formula:

$$5{,}000 \leqq X \cdot Y/(1-\sqrt{Z}) \leqq 25{,}000$$

wherein X is the weight percentage of said solid content in said release agent,

Y is the total quantity in $ml/m^2$ of said release agent that is applied, and

Z is the degree of vacuum in Torr in the interior of said assembled slab;

(f) subjecting the prepared assembled slab from step (e) to a hot-rolling to form said titanium alloy slab contained in said assembled slab into a titanium alloy sheet; and (g) removing said carbon steel envelope from the titanium alloy sheet to provide the titanium alloy sheet as a product.

2. The method as claimed in claim 1, wherein prior to said removing of said carbon steel envelope from said formed titanium alloy sheet, said hot-rolled assembled slab is subjected to a heat treatment.

3. The method as claimed in claim 2, wherein said heat treatment comprises a creep flattening.

4. The method as claimed in claim 1, wherein the high-energy-density welding is an electron beam welding.

5. The method as claimed in claim 1, wherein the solid content of release agent is selected from the group consisting of alumina, zirconia, boron nitride and titania.

6. The method as claimed in claim 1, wherein the solid content of the releasing agent is alumina.

7. The method as claimed in claim 1, wherein the heat treatment is conducted at 720° C. for 1 hour.

8. The method as claimed in claim 1, wherein the alloy slab has a composition selected from the group consisting of a Ti-4.5 wt. % Al-3 wt. % V-2 wt. %, Mo-2 wt. % Fe alloy, a Ti-6 wt. % Al-4 wt. % V alloy, a Ti-6 wt. % Al-2 wt. % Sn-4 wt. % Zr-6 wt. % Mo alloy, a Ti-8 wt. % Al-1 wt. % Mo-1 wt. % V alloy, and a Ti-5 wt. % Al-2.5 wt. % Sn alloy.

* * * * *